United States Patent [19]

Pratt et al.

[11] 4,415,029

[45] Nov. 15, 1983

[54] DOWNHOLE WELL TOOL AND ANCHORING ASSEMBLY

[75] Inventors: Donna K. Pratt; Jamie B. Terrell, both of Fort Worth, Tex.

[73] Assignee: Gearhart Industries, Inc., Fort Worth, Tex.

[21] Appl. No.: 286,146

[22] Filed: Jul. 23, 1981

[51] Int. Cl.[3] ..... E21B 23/04; E21B 29/02

[52] U.S. Cl. ..... 166/212; 166/217; 166/55.1; 166/63

[58] Field of Search ..... 166/217, 212, 120, 299, 166/63, 55, 55.1; 92/130 R

[56] References Cited

U.S. PATENT DOCUMENTS

| | | | |
|---|---|---|---|
| 2,603,163 | 7/1952 | Nixon | 166/212 |
| 2,874,784 | 2/1959 | Baker et al. | 166/212 |
| 3,406,758 | 10/1968 | Page | 166/212 |
| 3,741,302 | 6/1973 | Brown | 166/212 X |
| 4,180,131 | 12/1979 | Chammas | 166/212 X |
| 4,345,646 | 8/1982 | Terrell | 166/212 X |

*Primary Examiner*—Stephen J. Novosad
*Assistant Examiner*—Michael Starinsky
*Attorney, Agent, or Firm*—William D. Jackson

[57] ABSTRACT

Downhole well tools and anchoring means therefore including a chemical cutting tool having improved slip actuating and slip array assemblies. The cutting tool includes a slip shaft provided with fluid passageway and having a slip array slidably disposed thereon. The tool further includes slip expansion means secured to the shaft adjacent to the slip array. A piston sleeve is slidably disposed on the shaft and connected to the slip array and defines a piston chamber in fluid communication with the shaft passageway such that the application of fluid pressure drives the piston sleeve and slip array to a deployed position in which the slip array is expanded. Biasing means located externally of the piston sleeve function to bias the piston sleeve to a retracted position upon release of fluid pressure. The slip array is comprised of spaced slip segments which are biased inwardly by means of cantilever springs secured to a structural member of the logging tool.

18 Claims, 7 Drawing Figures

FIG. 3
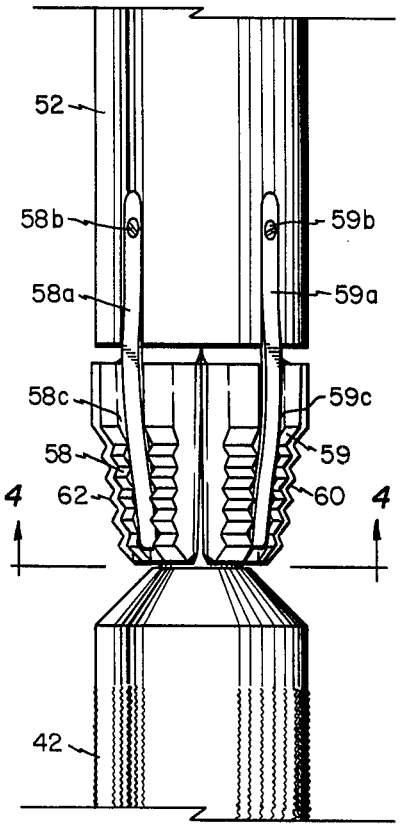
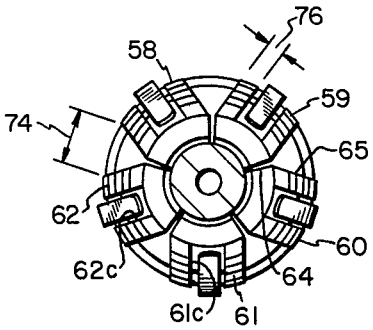
FIG. 4
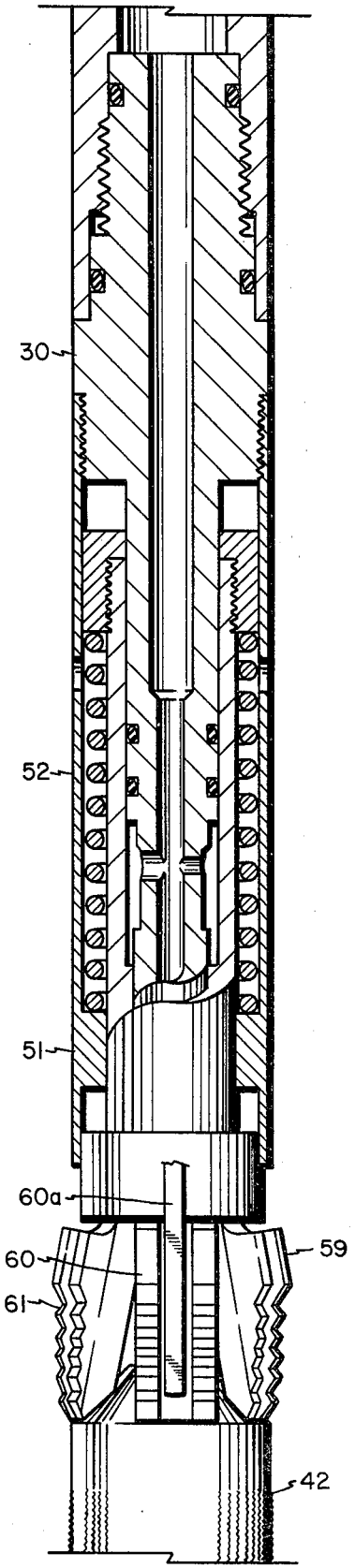
FIG. 7

DOWNHOLE WELL TOOL AND ANCHORING ASSEMBLY

BACKGROUND OF THE INVENTION

This invention relates to downhole well tools and anchoring systems therefore and more particularly to downhole chemical cutting tools and quick release anchoring systems especially suited for use in such tools.

There are many circumstances in the oil industry where it is desirable to cut or completely sever downhole tubular goods within a well. For example, in the course of drilling well, drill pipe may become stuck or "frozen" at a location well below the surface of the earth. This may result, for example, from "key seating" in which a drill collar or other section of the drill string becomes lodged against the side of the well, or the drill string may become stuck as a result of cuttings which settle within the well around the lower portion of the drill string. Similarly in the completion or operation of oil or gas wells, it is often necessary to carry out downhole cutting operations. For example, it may be desirable to sever casing or tubing at a downhole location in order to make repairs or to withdraw the tubing or casing from a well which is being abandoned.

In other circumstances, it is desirable to cut slots, grooves or perforations in downhole tubular goods. For example the perforating of the casing and the surrounding cement sheath to provide fluid access to a hydrocarbon bearing formation is a conventional expedient. Similarly it is often desirable to perforate tubing in the completion or recompletion of a well.

While mechanical means may be employed to cut openings or to completely sever downhole tubular goods, this is often accomplished through chemical cutting techniques. Many times shaped charges are employed to perforate or sever tubular goods within the well. However, another technique which can often be used to great advantage is the application of a chemical which cuts through metal tubular goods in the well by direct chemical reaction. For example U.S. Pat. No. 2,918,125 to Sweetman discloses a downhole chemical cutter in which halogen fluorides are employed in jet cutting streams. The attendant reaction is highly exothermic and the tubing, drill pipe, etc. is rapidly penetrated.

During the course of the cutting operation, it is desirable to anchor the cutting tool at the desired location within the well. This is particularly the case where the cutting tool is run into the well on a wire line. One technique for anchoring the tool employs use of fluid pressure from a suitable source to both activate the anchoring means and to dispell cutting fluid from the tool against the surface to be severed or otherwise cut. For example, U.S. Pat. No. 4,125,161 to Chammas discloses a cutting tool in which gas from a propellant charge displaces a piston to cam one or more wedges outwardly against the tubing string or other object to be cut. The gas from the propellant charge is also employed to force the cutting chemical into contact with a preignitor and thence outwardly through ports into contact with the tubular goods.

A particularly effective chemical cutting tool is disclosed in U.S. Patent application Ser. No. 078,472 filed Sept. 24, 1979 by Jamie B. Terrell, now U.S. Pat. No. 4,345,646. In this tool a chemical module assembly is located intermediate a propellant and slip assembly and a discharge head assembly. Gas pressure generated by the ignition of a propellant charge is employed to rapidly move a slip array against a slip expander, during which time the cutting action takes place. The slip array is then rapidly retracted by means of a biasing mechanism. The slip segments are disposed in the array in a manner to provide maximum utilization of surface area of the slip assembly for engaging the surrounding tubular goods.

SUMMARY OF THE INVENTION

In accordance with the present invention there is provided a new chemical cutting tool having improved slip actuating means and a new and improved slip array configuration which is particularly useful in chemical cutting tools. The chemical cutting tool of the present invention comprises an elongated slip shaft having a fluid passage extending longitudinally therethrough and equipped with at least one exhaust port providing fluid communication between the passage and the exterior of the slip shaft. A slip array comprising a plurality of slip segments is slidably disposed on the slip shaft. The tool further includes slip expansion mandrel means secured to the shaft adjacent to the slip array. The expansion means provides a tapered surface adapted to receive the slip segments to expand the slip array in a deployed position. A piston sleeve is slidably disposed on the shaft and connected to the slip array. The piston sleeve is of a configuration to define a piston chamber which opens to the exhaust port. This chamber has an active surface interposed between the port and the slip expander such that the application of pressure via the passage and port to the active surface forces the slip array in the direction of the expansion means. Biasing means in the tool located externally of the piston sleeve function to bias the piston sleeve in a direction away from the mandrel means to a retracted position as the pressure in the piston chamber is released.

In a further aspect of the invention, the improved well tool anchoring means comprises a slip array located on a slip shaft and interposed between suitable actuation means and slip expansion means. The slip segments are disposed in the array in a manner to provide a spacing between adjancent slip segments when the array is in the retracted position. In this position the maximum distance between the adjacent slip segments occurs at the gripping surfaces thereof. The slip segments are biased inwardly by the means of cantilever springs secured to a structural member of the cutting tool and projecting into engagement with the slip segments. Preferably the slip segments are arranged in the array in a diametrically asymmetrical relationship.

BRIEF DESCRIPTION OF THE DRAWINGS

FIG. 3 is a side elevational view of the slip array shown in FIG. 2.

FIG. 4 is a view, partly in section, taken along line 4—4 of FIG. 2.

FIG. 7 is a side elevational view, partly in section, showing the slip array of FIG. 3 partially expanded.

DESCRIPTION OF PREFERRED EMBODIMENTS

The present invention provides several improvements in anchoring assemblies for downhole well tools. These include operating means adapted to be actuated by fluid pressure developed in chemical fluid jet cutting tools and slip assemblies which are suitable for rapid deployment and retraction with a decreased likelihood of being rendered inoperative or hanging up the tool due to mud, paraffin deposits, or other accumulations which may be encountered within a well. The slip assembly, while suitable for use in other tools, is particularly well adapted for use in downhole chemical fluid jet cutting tools and the invention will be described in detail with reference to such tools.

Figure 1:
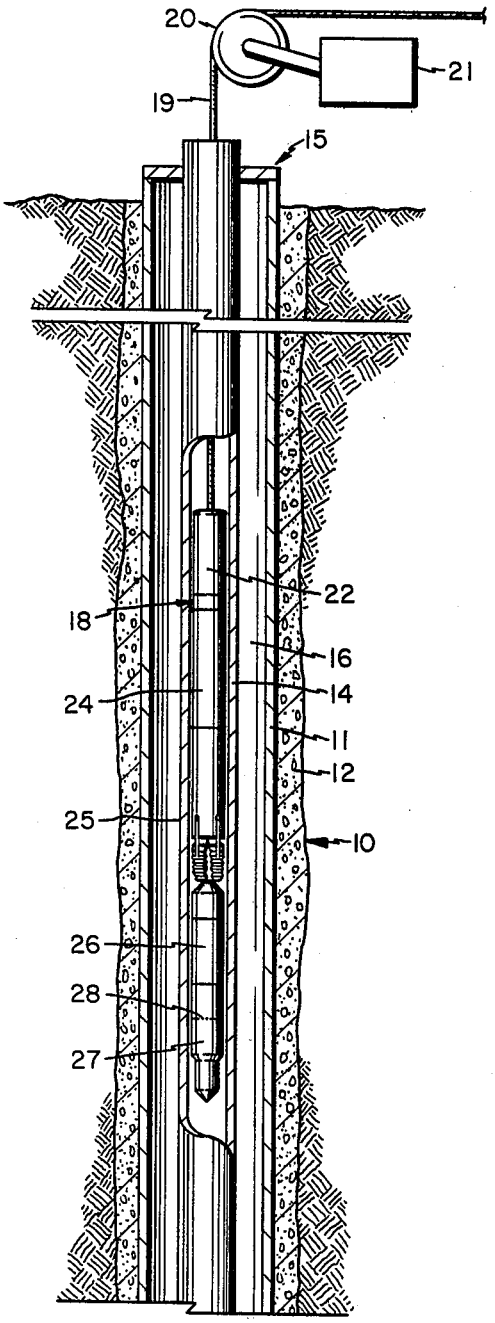
FIG. 1 is an illustration, partly in section, showing a downhole chemical cutter located in a well.

Turning first to FIG. 1 of the drawing, there is illustrated a chemical cutting tool embodying the present invention disposed within a well extending from the surface of the earth to a suitable subterranean location, e.g. an oil and/or gas producing formation (not shown). More particularly and as is illustrated in FIG. 1, a wellbore 10 is provided with a casing string 11 which is cemented in place by means of a surrounding cement sheath 12. A production tubing string 14 is disposed in the well as illustrated and extends from the well head 15 to a suitable downhole location. The tubing string and/or the annular space 16 between the tubing and the casing may be filled with high pressure gas and/or a liquid such as oil or water. Alternatively the tubing string or the annulus may be "empty", i.e. substantially at atmospheric pressure.

As further illustrated in FIG. 1, there is shown a chemical cutting tool 18 which is suspended from a cable (wire line) 19. The cable 19 passes over suitable indicating means such as a measuring sheave 20 to a suitable support and pulley system (not shown). The measuring sheave produces a depth signal which is applied to an indicator 21 which gives a readout of the depth at which the tool is located. It will, of course, be recognized that the well structure illustrated is exemplary only and that the cutting tool can be employed in numerous other environments. For example instead of a completed well, the tool can be employed in severing a drill pipe in either a cased or uncased well. In this case the tubing string shown would be replaced by a string of drill pipe.

The chemical cutter 18 is composed of five sections. At the upper end of the tool there is provided a fuse assembly 22 comprised of a firing adaptor, firing sub and an electrically activated fuse. Immediately below the fuse assembly 22 is a propellant section 24 which provides a source of high pressure gas. For example the propellant section may take the form of a chamber containing power pellets such as gun powder which burns to produce the propellant gases. Immediately below the propellant section 24 is a slip section 25 described in greater detail hereinafter. A chemical module section 26 is located below the slip assembly. This section contains a suitable chemical cutting agent such as a halogen fluoride. Normally the chemical cutting agent will take the form of bromine trifluoride. Immediately below the chemical section is a head assembly 27. This section contains an "ignitor hair" such as steelwool which activates the halogen fluoride. The head assembly also contains cutting ports through which the fluid is directed against the interior wall of the tubing. In this case, the head section is equipped with ports 28 extending about the periphery thereof to completely sever the tubing in the well.

The operation of the chemical cutting tool may be described briefly as follows. The tool is run into the well on the wire line 19 to the desired depth at which the cut is to be made. An electrical signal is then sent via wire line 19 to the cutter tool where it sets off the fuse, in turn igniting the power pellets. As these pellets burn, a high pressure gas is generated and travels downwardly through the slip section and forces a slip array outwardly in a manner described hereinafter. The slip array thus anchors the cutter in the tubing. As the gas pressure further increases, seal diaphragms within the chemical module are ruptured and the halogen fluoride is forced through the ignitor hair which pre-ignites the chemical. The gas pressure then forces the activated chemical into the head section and ultimately outwardly through ports 28. In a short period of time, normally less than a second, the tubing is severed and the slip array is retracted so that the tool can then be withdrawn from the borehole. For a further description of the general operating conditions and parameters employed in the tool, reference may be made to the aforementioned application Ser. No. 078,472 by Terrell.

Figure 2:
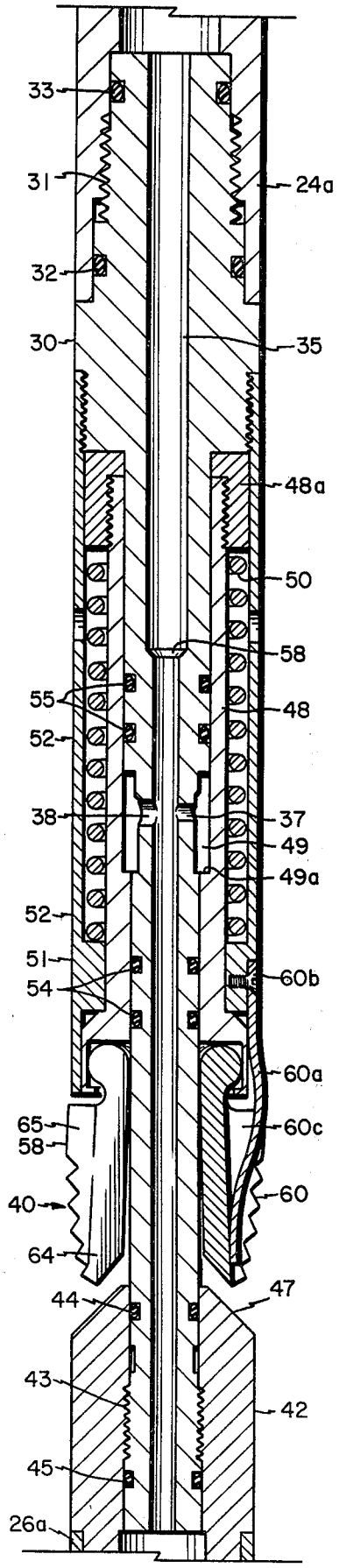
FIG. 2 is an illustration, partly in section, of a portion of the cutting tool illustrating a slip assembly and actuating mechanism constructed in accordance with the present invention.

Turning now to FIG. 2 there is shown an enlarged sectional view of the slip section 25 which embodies the improved actuating mechanism and slip array configuration of the present invention. The slip assembly comprises an elongated slip shaft 30 which extends from the housing **24*a* of the propellant section to the housing 26*a* of the chemical section of the tool. The slip assembly 30 is secured to the propellant housing 24*a* by means of a threaded connection 31 and this connection is provided with a fluid seal by suitable packing means, such as O-rings 32 and 33**.

The slip shaft is provided with a longitudinal passage 35 which provides for fluid communication between the propellant section and the chemical section. The slip shaft is also provided with one or more exhaust ports which extend transversely from the passage 35 to the exterior surface of the slip shaft. In the embodiment disclosed, the slip shaft is provided with two exhaust ports 37 and 38. Preferably at least one exhaust port is larger than another for reason described hereinafter. For example, port 37 may be $\frac{1}{8}''$ in diameter and port 38, 5/32" or 3/16" in diameter.

A slip array 40 comprising a plurality of slip segments, of which two are shown, is slidably disposed about the periphery of the slip shaft. A slip expansion mandrel 42 is secured to the slip shaft at a location adjacent to the slip array by any suitable means. For example, in the embodiment shown, the mandrel is mounted on the slip shaft by a threaded connection 43 with O-rings 44 and 45 disposed on either side thereof. The mandrel 42 is also secured to the housing **26*a* of the chemical section by a threaded connection (not shown). The portion of the mandrel next adjacent the slip array is frusto conical in shape to provide a tapered surface 47 adapted to receive the slip array to expand it into a deployed position. Thus, it can be seen from an examination of FIG. 2 that when the slip segments are moved downwardly, they are forced outwardly as they ride up on tapered surface 47**.

Each of the slip segments are pivotably mounted at the ends opposed to the expansion mandrel to a slip actuator. More particularly and as illustrated in FIG. 2, the slip actuator comprises a piston sleeve 48 which is slidably disposed on the exterior surface of the slip shaft. The piston sleeve 48 defines a piston chamber 49 into which the exhaust ports open, thus providing fluid communication between the chamber 49 and the passageway 35. The active surface 49*a* of the piston chamber 49 is interposed between the ports and the expansion mandrel. Thus, it can be seen from an examination of FIG. 2, that the application of pressure in the piston chamber 49 will drive the piston sleeve downwardly, forcing the slip array 40 against the expansion mandrel 42 in a deployed position.

The arrangement of the slip shaft and the piston sleeve enable the development at a location externally of the piston sleeve of means to bias the sleeve into the retracted position. In the preferred embodiment illustrated, the return means takes the form of a compression spring 50 mounted between a retainer element 48*a* which is threadedly secured to the piston sleeve and a shoulder 51 formed as part of a cover tube 52. Thus as the propellant charge is spent and the pressure within chamber 49 reduced, compression spring 50 returns the piston sleeve and slip array to the retracted position illustrated. From an examination of FIG. 2 it can be seen that the shoulder 51 is fixedly secured relative to the slip shaft 35 by virtue of a threaded connection between the slip shaft and the cover tube.

The arrangement illustrated in FIG. 2 offers an important advantage in that the slidable surfaces between the slip shaft and piston sleeve are relatively remote from the wellbore environment. In addition the exhaust ports can be provided with suitable packing means on either side thereof at locations where they are not readily subject to degredation by heat transfer from the exterior of the tool. In this regard, the hot gases developed almost instantaneously in the wellbore as a result of the reaction between the halogen fluoride and the metal cutting surface, produce temperatures in the vicinity of the slip assembly on the order of 1100° C. The O-rings 54 and 55 above and below chamber 49 are located well within the interior of the tool where they are relatively insensitive to direct heat transfer from the wellbore.

As noted previously, it is preferred to employ a plurality of exhaust ports with at least one port being larger than the other. In addition, it will be noted that the passageway 35 is reduced as indicated by reference numberal 58 at a location between the end of the slip shaft and the exhaust ports. This provides for ease in machining the passageway and in addition provides for an increased flow velocity through passageway 35 at the location of the exhaust ports. The size differential in the exhaust ports 37 and 38 tends to produce turbulence within the chamber 49. This chamber is normally packed with grease and the turbulence is provided to reduce the likelihood of packing within the chamber such as may be due to residue in the gas issuing from the propellant section.

The preferred form of slip array constructed in accordance with the present invention is illustrated by reference to FIG. 2 taken in conjunction with FIG. 3, which is a side elevation showing the slip array in the retracted position and the adjacent expansion mandrel. As illustrated in FIGS. 2 and 3, the slip segments 58, 59 and 60 are biased inwardly by means of cantilever springs 58*a*, 59*a*, and 60*a* which are secured to the cover tube 52, which, it will be recalled, is a structural member of the cutting tool. The springs may be secured to the cover tube by any suitable technique that provides for a cantilever-type relationship between the tube, the spring, and the slip segments. As a practical matter it will usually be preferred to simply fixedly secure the springs to the cover tube such as by screws 58*b*, 59*b*, and 60*b* as shown and to provide for slidable movement between the springs and the slip segments as the slip array is moved between the deployed and retracted position. Preferably the cantilever springs ride within slots 58*c*–62*c* extending longitudinally through the serrated gripping surfaces of the slip segments. As will be explained in greater detail hereinafter, this arrangement provides for some protection of the springs against the hot and corrosive gases flowing past the slip assembly.

Several important features will become apparent from examination of FIG. 3 and FIG. 4 which is a sectional view taken along lines 4—4 of FIG. 3. As shown in FIGS. 3 and 4, the slip array construction provides for spacing between adjacent slip segments when in the retracted position with the maximum distance between adjacent slip segments occurring at the outer gripping surfaces thereof. The preferred configurations of the slip segments are best shown in FIGS. 2 and 4. As there illustrated, each side of the slip segments comprises an inner surface 64 and an outer surface 65 which extends outwardly to a junction with the serrated gripping surface. As shown in FIG. 4 the outer surface 65 of a slip segment slopes inwardly toward the center line of the segment relative to the inner surface 64. This arrangement provides for good spacing between the serrated gripping surfaces of the slip segments in a manner consistent with adequate strength of the slip elements and sufficient bearing surfaces on the bottom the slip segments which ride on the slip shaft.

The spacing provided between the slip segments offers several important advantages. The slips are readily moved outwardly into a gripping relationship with the surrounding tubing even in the presence of mud, mud cakes, paraffin deposits, etc. which may tend to obstruct the slip elements. In addition, should several or all of the slip elements fail to completely retract, the spacing between adjacent slip segments enables them to move thru mud or deposits in the well. Thus reduces the likelihood of the tool "hanging up" within the well. Another feature of the preferred embodiment illustrated resides in the fact that the slip elements are diametrically asymmetrical with one another as illustrated in FIG. 4. This can readily be accomplished by forming the slip array of an odd number of equal-sized slip elements. By thus providing that the slips are not diametrically opposed to one another as is conventionally done, the tool normally will be centralized more effectively within the tubing or other tubular goods to be cut.

Figure 5:
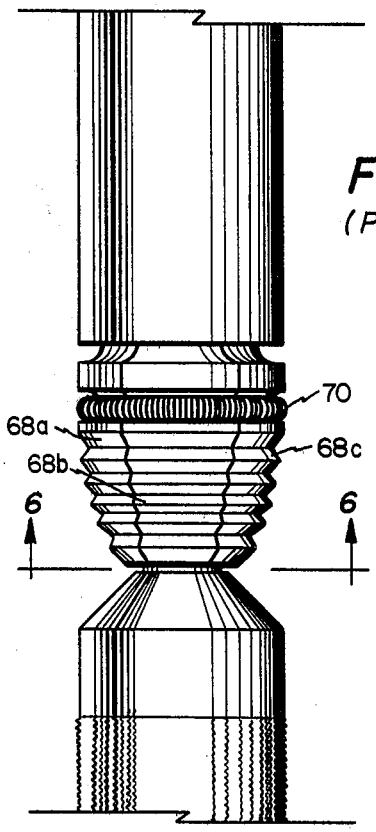
FIG. 5 (PRIOR ART)
FIG. 5 is a side elevational view of a slip array constructed in accordance with the prior art.
Figure 6:
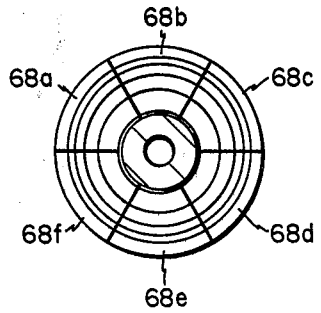
FIG. 6 (PRIOR ART)
FIG. 6 is a view, partly in section, taken along line 6—6 of FIG. 5.

The several advantages accruing to the preferred slip array structure of the present invention can be appreciated by reference to the prior art structure shown in FIGS. 5 and 6. FIG. 5 is a side elevation corresponding generally to FIG. 3, but of a prior art slip array configuration, and FIG. 6 is a sectional view taken along lines 6—6 of FIG. 5. The slip segments 68*a*–68*f* are biased inwardly by means of a tension spring 70 surrounding the slip segments as shown in FIG. 5. As is evident from an examination of FIG. 5, failure of the spring may result in all of the slips remaining in an extended position. However, by employing the separate spring element shown in FIG. 3 in accordance with the present invention, spring failure will effect only one slip, thus lessening the likelihood of a stuck tool. A more important distinction can be seen from examination of the prior art slip array shown in FIG. 6. As there indicated, the sides of slip segments extend generally radially outwardly and are in close proximity to one another. By providing the multi-surfaced configuration shown in FIGS. 3 and 4, when the slips are released there is less likelihood of mud or other debris preventing their return to the retracted position. This can also be seen from an examination of FIG. 7 which is an illustration of the slip assembly of the present invention, corresponding generally to FIG. 2, but showing a side elevation of the slip array in a partially expanded position. As can be seen as the slips start to move from the deployed position to the retracted position shown in FIG. 3, there remains spaces in the slip array through which mud or other debris can be "squeezed" out as the slip array is retracted. This further reduces the likelihood of the tool becoming stuck in the well.

Additional advantages resulting from the use of cantilever springs which ride in the longitudinal slots of the slip segments can be understood by reference to FIGS. 4 and 7. In this regard, when the slip array is deployed, the segments tend to shield the springs from hot gases issuing upwardly through the hole as a result of the cutting reaction. Also, the grooves extending through the serrated gripping surface, in addition to the spacing between the slip segments, reduces the fraction of the slip array circumference which actually grips the tubing wall. Preferably the sum of the arcs defined by the actual gripping surfaces of the slip segments are significantly less than one-half of the circumference circumscribing the slip segments in the deployed position. This is not the case in the prior art arrangement where an effort is made to secure maximum contact between the slip surfaces and the tubular goods to be cut. In fact, it is preferred in arranging the slip segments of the present invention, to provide that the spacing between the slip segments including the slots, even when the array is in the retracted position, is greater than the portion of the circumference actually circumscribed by the bearing surfaces of the slip elements. As stated otherwise the sum of the width of the slots 58c–62c and the spaces between adjacent segments, e.g. as indicated by dimension 74 of FIG. 4 are greater than the sum of the arcs indicated by dimension 76 of the bearing surfaces of the slip segments.

Having described specific embodiments of the present invention, it will be understood that certain modifications thereof may be suggested to those skilled in the art and it is intended to cover all such modifications as fall within the scope of the appended claims.

We claim:

1. In a downhole chemical cutting tool having a chemical section adapted to contain a chemical cutting agent and a cutting section in fluid communication with said chemical section and having cutting ports for the discharge of chemical cutting agent, said tool adapted to be insertd into a wellbore and anchored at a downhole location thereof, the combination comprising:

(a) an elongated slip shaft extending longitudinally of said tool;

(b) a slip array comprising a plurality of slip segments having serrated outside gripping surfaces slidably disposed on the peripheral surface of said slip shaft and pivotally mounted at one end to slip actuation means;

(c) slip expansion mandrel means secured to said shaft at a location between said cutting ports and said slip array and having a tapered surface adapted to receive said slip segments to expand said array in a deployed position upon the movement of said array in the direction of said mandrel means.

(d) means biasing said slip segments inwardly about said slip shaft as said slip array is withdrawn from a deployed position and moved away from said mandrel means to a retracted position, said biasing means comprising cantilever springs secured to a structural member of said tool behind said slip array and projecting forwardly into engagement with said slip segments to bias said slip segments inwardly as said slip array is withdrawn from said deployed position to the retracted position; and (e) said slip array being arranged in the retracted position to provide a spacing between adjacent slip segments with the maximum distance between adjacent slip segments occurring between the gripping surfaces of adjacent slip segments.

2. The combination of claim 1 wherein said slip segments are arranged in said array in a diametrically asymmetrical relationship.

3. The combination of claim 1 wherein said array is composed of an odd number of segments.

4. The combination of claim 1 wherein the sides of said slip segments comprise inner and outer surfaces, said outer surfaces intersecting said serrated gripping surfaces and sloping with respect to said inner surfaces toward the center lines of said slip segments.

5. The combination of claim 4 wherein the serrated gripping surfaces of said slip segments comprise less than one-half of the circumference defined by said slip segments when said array is in the deployed position.

6. The combination of claim 1 wherein the outside gripping surfaces of said slip segments have slots extending longitudinally of said slip segments and wherein said cantilever springs extend into said slots to engage said slip segments.

7. The combination of claim 6 wherein, when said array is in the retracted position, the portion of the slip array circumference defined by said slots and the spacings between said slip segments is greater than the portion of said circumference defined by the serrated gripping surfaces of said segments.

8. In a downhole chemical fluid jet cutting tool having a chemical section adapted to contain a chemical cutting agent and a cutting section in fluid communication with said chemical section and having cutting ports for the discharge of chemical cutting agent, said tool adapted to be inserted into a wellbore and anchored at downhole location by application of fluid pressure, the combination comprising:

(a) an elongated slip shaft extending longitudinally of said tool and having a fluid passage extending longitudinally therethrough and at least one exhaust port extending transversely of said slip shaft from said passage to the exterior surface of said slip shaft;

(b) a slip array comprising a plurality of slip segments slidably disposed on the peripheral surface of said slip shaft;

(c) slip expansion mandrel means secured to said shaft adjacent to said slip array and having a tapered surface adapted to receive said slip segments to expand said array in a deployed position;

(d) a piston sleeve slidably disposed on said shaft and connected to said slip array, said sleeve defining a piston chamber in fluid communication with said exhaust port having an active surface interposed between said port and said slip expansion mandrel means whereby the application of pressure to said active surface forces said slip array in the direction of said mandrel means; and (e) biasing means located externally of said piston sleeve for biasing said piston sleeve in a direction away from said mandrel means to a retracted position upon a decrease in pressure within said chamber.

9. The combination of claim 8 wherein said slip segments are arranged in said array in a diametrically asymmetrical relationship.

10. The combination of claim 9 wherein said array is composed of an odd number of segments.

11. The combination of claim 8 further comprising packing means disposed between said slip shaft and said piston sleeve on each side of said exhaust port.

12. The combination of claim 8 comprising a plurality of exhaust ports, one of said exhaust ports being larger than another of said exhaust ports.

13. The combination of claim 8 further comprising a cover tube secured to said slip shaft and extending exteriorly of said piston sleeve in the direction of said slip array, and cantilever springs secured to said cover tube and projecting beyond said cover tube into engagement with said slip segments to force said slip segments inwardly as the slip array is withdrawn from the deployed position to the retracted position.

14. The combination of claim 13 wherein said biasing means comprises a compression spring located between said piston sleeve and said cover tube and interposed between a first retaining element secured to the outer surface of said piston sleeve and a second retainer element secured to the inner surface of said cover tube at a location intermediate said first element and said slip array.

15. The combination of claim 13 wherein the sides of said slip segments comprise inner and outer surfaces, said outer surfaces intersecting said serrated gripping surfaces and sloping with respect to said inner surfaces toward the center lines of said slip segments.

16. The combination of claim 15 wherein the serrated gripping surfaces of said slip segments comprise less than one-half of the circumference defined by said slip segments when said array is in the deployed position.

17. The combination of claim 13 wherein the outside gripping surfaces of said slip segments have slots extending longitudinally of said slip segments and wherein said cantilever springs extend into said slot to engage said slip segments.

18. The combination of claim 17 wherein, when said array is in the retracted position, the portion of the slip array circumference defined by said slots and the spacings between said slip segments is greater than the portion of said circumference defined by the serrated gripping surfaces of said segments.

* * * * *